US005678451A

United States Patent [19]

Vergneau et al.

[11] Patent Number: 5,678,451

[45] Date of Patent: Oct. 21, 1997

[54] JOG AND SHUTTLE CONTROLS FOR ELECTRONIC OR ELECTRICAL DEVICES

[75] Inventors: Gerard Vergneau, Osny; Philippe Starck, Issy les Moulineaux, both of France

[73] Assignee: Thomson Multimedia S.A., Courbevoie, France

[21] Appl. No.: 504,711

[22] Filed: Jul. 20, 1995

[30] Foreign Application Priority Data

Aug. 2, 1994 [FR] France ..... 94 09588

[51] Int. Cl.[6] ..... G05G 1/10

[52] U.S. Cl. ..... 74/10 R; 74/553

[58] Field of Search ..... 74/10 R, 10.5, 74/553; 200/11 R, 14

[56] References Cited

U.S. PATENT DOCUMENTS 2,868,025 1/1959 Spear ..... 74/553 X 3,066,550 12/1962 Sundberg ..... 74/553 X 3,597,996 8/1971 Gouwens et al. ..... 74/553

4,947,097 8/1990 Tao ..... 74/553 X 5,289,439 2/1994 Koulopoulos et al. ..... 369/32

*Primary Examiner*—Allan D. Herrmann

*Attorney, Agent, or Firm*—Joseph S. Tripoli; Frederick A. Wein; Francis A. Davenport

[57] ABSTRACT

The present invention concerns an improvement to the "jog and shuttle" knobs used on electronic or electrical devices, notably video devices such as video recorders. The control according to the invention includes a knob mounted inside a cavity in the face-plate of the control panel such that the external face of the knob is aligned with said face-plate, and a finger fixed to a ring mounted coaxially with the knob, the finger being mounted such that it moves around the arc of a circle in the cavity.

12 Claims, 1 Drawing Sheet

JOG AND SHUTTLE CONTROLS FOR ELECTRONIC OR ELECTRICAL DEVICES

BACKGROUND OF THE INVENTION

The present invention relates to an improvement to the "jog and shuttle" controls used on electronic or electrical devices, notably video devices such as video recorders.

Known jog and shuttle controls for video recorders, mounted either directly on the control panel of the recorder or on the remote control unit, comprise essentially two concentric means of control. They include, in particular, an annular ring that enables the forward and reverse reading speeds to be regulated by rotating the ring, and a second means in the form of a central knob generally having a small cavity in the shape of a finger tip which provides for various functions, notably image-by-image display, stopping on an image, and changing channels. On video recorders or their remote controllers currently on the market, these controls are mounted protruding from the face-plate of the control panel; they are therefore unattractive and cumbersome.

SUMMARY OF THE INVENTION

The goal of the present invention is to propose a new type of jog and search control that overcomes the disadvantages mentioned above, notably in that it does not protrude beyond the face-plate of the control panel.

The object of the present invention is therefore a jog and shuttle control for electronic or electrical devices of the type including at least one first means of control fitted inside a cavity in the face-plate of the control panel such that it can move inside this cavity around an axis, wherein a second means of control is included in the form of a knob mounted coaxially with said first means of control within the cavity such that the external face of the knob is aligned with said face-plate, said first means being concentrical to the knob.

Another characteristic of the invention is that the shape of the cavity is substantially spherical or cylindrical.

According to a preferred embodiment, said first means is a finger fixed to a ring mounted coaxially with the knob.

Another characteristic is that the knob is offset laterally from the center of the cavity, the external surface of the knob being tangential to one of the edges of the cavity and the finger being mounted such that it moves around the arc of circle on the opposite side to the point of tangency.

BRIEF DESCRIPTION OF THE DRAWINGS

The invention will be better understood and other advantages and characteristics will become clear on reading the following description of a preferred embodiment making reference to the appended figures, of which:

In FIGS. 1 and 2, reference 1 designates the face-plate of the control panel of a video recorder. However, it will be obvious to professionals of the art that the jog and shuttle control according to the invention can also be mounted on a remote-control unit of video recorder in a similar way to the embodiment shown here. A cavity 2 has been made in this face-plate 1. As shown more clearly in FIG. 2, the cavity 2 is of spherical form and of a diameter sufficiently large to receive the whole of the jog and shuttle control and enable its manipulation. As shown in FIGS. 1 and 2, the jog and shuttle control is constituted essentially by a knob 3 mounted on a spindle 4 coaxial with the axis a. The knob 3 can be fixed, having a purely decorative function. The knob 3 can be mobile, rotating about the axis or moving along the direction of this axis. In this case, this knob 3 enables image-by-image viewing with the possibility of stopping on an image or changing channels. The knob 3 provides in fact the same functions as the central knob of the conventional type of jog and shuttle control. It is mounted within the cavity 2 such that its external face 3' is aligned with the face-plate 1 of the control panel. As shown in FIG. 2, the knob is not cylindrical: the shape of its rear face is substantially spherical, so as to fit snugly in the cavity 2. Moreover, according to the present invention and as shown in FIGS. 1 to 3, the first means of control that enable the forward and reverse reading speeds to be varied is constituted by a finger 5 fixed to an annular ring 6 mounted, as shown in FIG. 2, coaxially with the spindle 4 on the axis a. The assembly comprising the annular ring 6 and the finger 5 is also mounted within the cavity 2 such that it can turn in this cavity along the arc of a circle 7. In addition, the shape of the finger 5 is such that its upper surface 5' is elliptical and aligned with the face-plate of the control panel. Consequently, owing to its design, none of the parts comprising the jog and shuttle control protrudes from the face-plate of the control panel.

Figure 1:
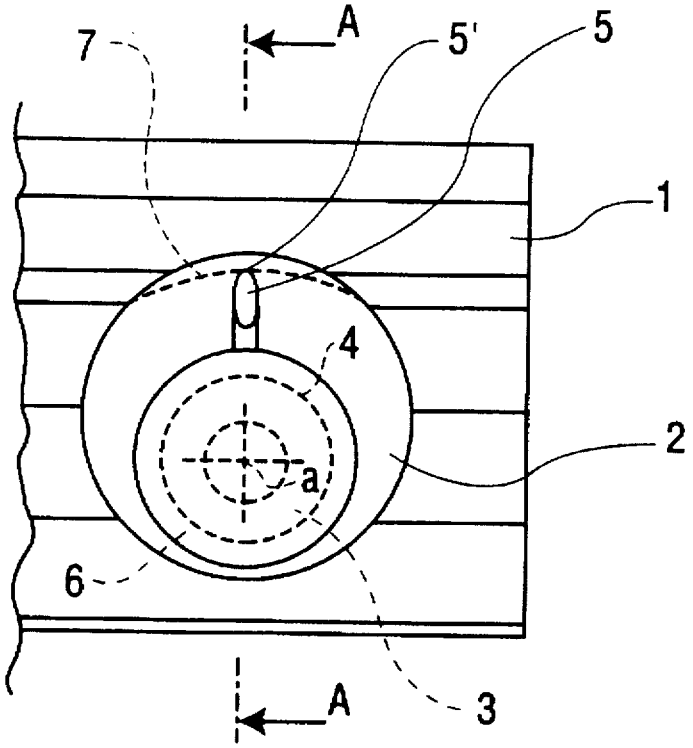
FIG. 1 shows a front view of part of the face-plate of a video recorder fitted with a jog and search control according to the present invention.
Figure 2:
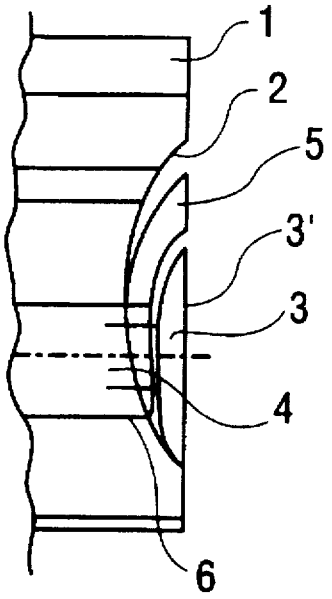
FIG. 2 is a view of the section 2—2 of FIG. 1.
Figure 3:
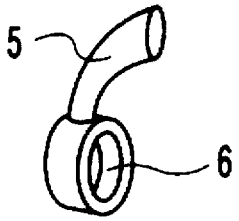
FIG. 3 is perspective view of the finger used in the jog and shuttle control of FIG. 1.

It will be obvious to professionals of the art that the various parts of the jog and shuttle control according to the present invention can be modified, notably the shapes of the cavity which can also be cylindrical, the knob and the finger, while remaining within the scope of the invention.

What is claimed is:

1. Jog and shuttle control for a control panel of an electronic or electrical appliance comprising:
   - the control panel having a front face and fitted with a substantially spherical cavity;
   - the cavity being centered on an axis of the cavity;
   - the jog and shuttle control having a first and second control means wherein the second control means is in the form of a knob secured on a shaft having an axis of the shaft;
   - the knob having a front face, the front face of the knob being disposed in said cavity and aligned with the front face of the control panel;
   - the first control means being in the form of a finger affixed to a ring mounted coaxially with said knob.

2. Jog and shuttle according to claim 1 wherein said knob is rotatable around said axis of said shaft.

3. Jog and shuttle according to claim 1 wherein said knob is movable along said axis of said shaft.

4. Jog and shuttle according to claim 1 wherein the axis of the cavity is different from the axis of said shaft.

5. Jog and shuttle according to claim 1 wherein an edge of the knob is tangential to an edge of said cavity.

6. Jog and shuttle according to claim 1 wherein an end of said finger can rotate, said end running along an arc of a circle in the cavity.

7. Jog and shuttle control for a control panel of an electronic or electrical appliance comprising:
   - the control panel having a front face and fitted with a substantially cylindrical cavity;
   - the cavity being centered on an axis of the cavity;
   - the jog and shuttle control having a first and second control mean wherein the second control mean is in the form of a knob secured on a shaft having an axis of the shaft;

the knob having a front face, the front face of the knob being disposed in said cavity and aligned with the front face of the control panel, the first control means being in the form of a finger affixed to a ring mounted coaxially with said knob.

8. Jog and shuttle according to claim 7 wherein said knob is rotatively mobile around said axis of said shaft.

9. Jog and shuttle according to claim 7 wherein said knob is mobile along said axis of said shaft.

10. Jog and shuttle according to claim 7 wherein the axis of the cavity is different from the axis of said shaft.

11. Jog and shuttle according to claim 7 wherein an edge of the knob is tangential to an edge of said cavity.

12. Jog and shuttle according to claim 7 wherein an end of said finger can rotate, said end running along an arc of a circle in the cavity.

* * * * *